US008425019B2

(12) United States Patent
Iwase

(10) Patent No.: US 8,425,019 B2
(45) Date of Patent: Apr. 23, 2013

(54) IMAGE FORMING APPARATUS

(75) Inventor: Fumiyoshi Iwase, Hamamatsu (JP)

(73) Assignee: Roland DG Corporation, Hamamatsu-Shi (JP)

( * ) Notice: Subject to any disclaimer, the term of this patent is extended or adjusted under 35 U.S.C. 154(b) by 343 days.

(21) Appl. No.: 12/704,489

(22) Filed: Feb. 11, 2010

(65) Prior Publication Data

US 2010/0214332 A1 Aug. 26, 2010

(30) Foreign Application Priority Data

Feb. 26, 2009 (JP) ..... 2009-43470

(51) Int. Cl.
*B41J 2/175* (2006.01)

(52) U.S. Cl.
USPC ..... 347/85; 347/7

(58) Field of Classification Search ..... 347/5, 7, 347/85, 19
See application file for complete search history.

(56) References Cited

U.S. PATENT DOCUMENTS

| | | | | |
|---|---|---|---|---|
| 5,856,839 | A * | 1/1999 | Aukstikalnis et al. | 347/86 |
| 6,123,403 | A * | 9/2000 | Makino et al. | 347/5 |
| 6,796,627 | B2 * | 9/2004 | Kimura et al. | 347/7 |
| 6,929,341 | B2 * | 8/2005 | Mizoguchi et al. | 347/7 |
| 2006/0036377 | A1 * | 2/2006 | Nishihara | 702/55 |
| 2007/0058009 | A1 * | 3/2007 | Furukawa et al. | 347/85 |
| 2008/0198187 | A1 * | 8/2008 | Aoki et al. | 347/7 |
| 2009/0267988 | A1 * | 10/2009 | Matsui et al. | 347/42 |

FOREIGN PATENT DOCUMENTS

JP 2007044929 A * 2/2007

* cited by examiner

*Primary Examiner* — Julian Huffman
*Assistant Examiner* — Sharon A Polk
(74) *Attorney, Agent, or Firm* — Lee, Hong, Degerman, Kang & Waimey

(57) ABSTRACT

An image forming apparatus is presented. The image forming apparatus includes an ink tank configured to store ink, a recording head configured to discharge ink stored in the ink tank onto a recording medium, an adjustment device configured to adjust the flow of ink from the ink tank to the recording head, a damper configured to temporarily store ink that is output from the ink tank to the recording head, an ink condition sensor configured to detect a condition of the ink stored in the damper, and a control device configured to adjust the adjustment device according to the condition detected by the ink condition sensor.

17 Claims, 8 Drawing Sheets

IMAGE FORMING APPARATUS

CROSS-REFERENCE TO RELATED APPLICATIONS

Pursuant to 35 U.S.C. §119(a), this application claims the benefit of earlier filing date and right of priority to Japanese Application No. 2009-43470, filed on Feb. 26, 2009, the contents of which are hereby incorporated by reference herein in its entirety.

BACKGROUND OF THE INVENTION

1. Field of the Invention

The present invention relates to an inkjet printing apparatus that forms images on a recording media by discharging ink droplets on the recording media.

2. Discussion of the Related Art

Conventionally, inkjet printers form images by discharging ink droplets from a recording head while intermittently moving a recording medium as the recording head is displaced in a main scanning direction which is orthogonal to the feeding direction, or auxiliary scanning direction, of the recording medium.

In a conventional inkjet printer, an image forming process is interrupted when an ink tank runs out of ink. The interruption may lead to a decline in the efficiency and accuracy of the image forming process. Japanese Laid-Open Patent Application H08-216426 and Japanese Laid-Open Patent Application 2002-29041 describe inkjet printers that are provided with a plurality of ink tanks for storing ink and monitoring the remaining amount of ink in each tank, such that, in order to continuously form images, the printer switches to a second ink tank as the ink in a first ink tank falls below a predetermined amount.

The conventional printer comprises a sensor for detecting the remaining amount of ink in each of the plurality of ink tanks. This, however, leads to a problem of a more complicated inkjet printer configuration, which causes lower manufacturing and maintenance efficiencies and higher manufacturing and maintenance costs. Specifically, the aforementioned deficiencies are prevalent in inkjet printers that form images on recording media with a size greater than A0, which require a greater amount of ink consumption and concurrently a greater number of ink tanks.

For ink tanks storing anaerobic ink, such as ink that deteriorates upon contact with specific gases, photophobic ink, such as ink that deteriorates upon contact with specific lights, and color ink, a method of detecting the ink level inside the ink tank, a method of detecting the weight of the ink tank, and a method of detecting ink tank deformation via flexible ink tanks are among the methods used for detecting the remaining amount of ink in ink tanks. However, the methods described above entail a problem in that, the detection accuracy of the remaining amount of ink is lessened for ink tanks with a large volume. Consequently, the lower detection accuracy, leads to an uneconomical disposal of larger amounts of ink. Additionally, large volume ink tanks require a sensor device that can cover a greater detection range, which also results in more complicated configurations and higher manufacturing costs.

The present invention aims to solve the problems described above by providing an image forming apparatus that can detect the remaining amount of ink in each of a plurality of ink tanks with a simple configuration and high accuracy, such that the configuration of the image forming apparatus can be simplified and resulting in reduced manufacturing and maintenance costs.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In accordance with an embodiment, an image forming apparatus is presented. The image forming apparatus includes an ink tank configured to store ink, a recording head configured to discharge ink stored in the ink tank onto a recording medium, an adjustment device configured to adjust the flow of ink from the ink tank to the recording head, a damper configured to temporarily store ink that is output from the ink tank to the recording head, an ink condition sensor configured to detect a condition of the ink stored in the damper, and a control device configured to adjust the adjustment device according to the condition detected by the ink condition sensor.

According to one feature, the image forming apparatus further includes a temporary storage device positioned in an ink flow path for temporarily storing ink to be output to the recording head, wherein the ink condition sensor device detects the amount of ink stored in the temporary storage device.

According to another feature, the temporary storage device has an ink storage capacity of 50 cc or less. Additionally, the image forming apparatus further includes a display device configured to display an operation status of the image forming apparatus, wherein the display device receives usage status information of the ink tank according to the amount of ink detected by the ink condition sensor device.

In accordance with another embodiment, an image forming apparatus is presented. The image forming apparatus includes a plurality of ink tanks configured to store ink, a recording head configured to discharge ink stored in the plurality of ink tanks onto a recording medium, an ink tank switching device configured to selectively switch among the plurality of ink tanks, an ink flow path configured to allow access to the ink between the plurality of ink tanks and the recording medium, an ink condition sensor situated on the ink flow path and configured to detect a condition of the ink output to the recording head, and a switching control device configured to control the ink tank switching device according to the condition detected by the ink condition sensor.

In accordance with yet another embodiment, a method of forming an image is presented. The method includes storing ink in a plurality of ink tanks, discharging ink via a recording head onto a recording medium, the recording head receiving ink via an ink flow path connected to the ink stored in the plurality of ink tanks, selectively switching an output from the plurality of ink tanks, detecting a condition of the ink output via an ink condition sensor situated on the ink flow path, and controlling the selective switching of the output from the plurality of ink tanks according to the condition detected by the ink condition sensor.

BRIEF DESCRIPTION OF THE DRAWINGS

FIGS. 4A and 4B illustrate the configuration of a damper and a film surface sensor provided on the recording head illustrated in FIG. 3, wherein FIG. 4A is a plan view of the damper, and FIG. 4B is a cross-sectional view of the damper and the film surface sensor illustrated in FIG. 4A.

DETAILED DESCRIPTION OF THE PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

An image forming apparatus in accordance with an embodiment of the invention will be described below with reference to the accompanying drawings.

Figure 1:
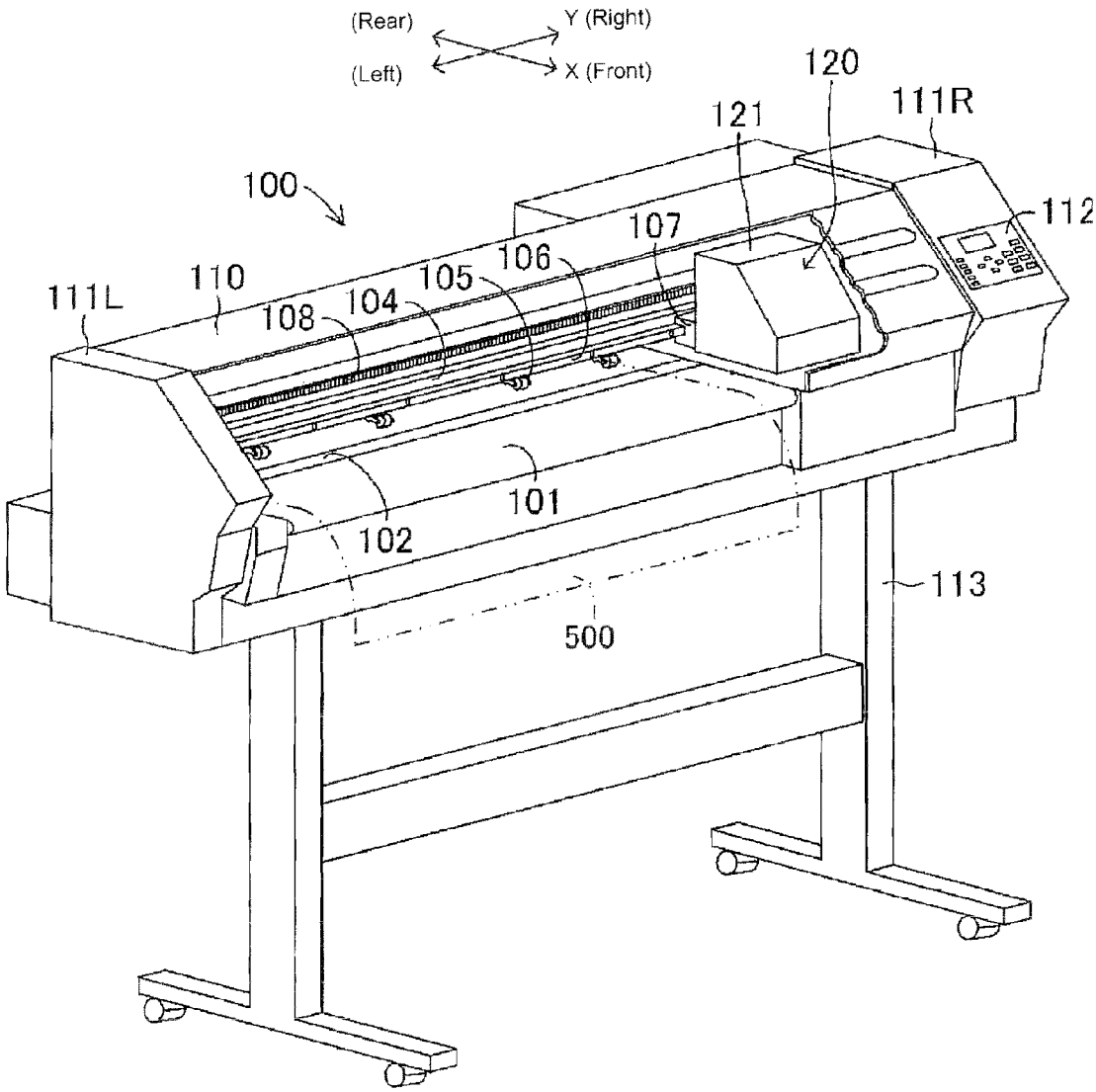
FIG. 1 illustrates an exterior perspective view showing the overall image forming apparatus according to an embodiment of the present invention.
Figure 2:
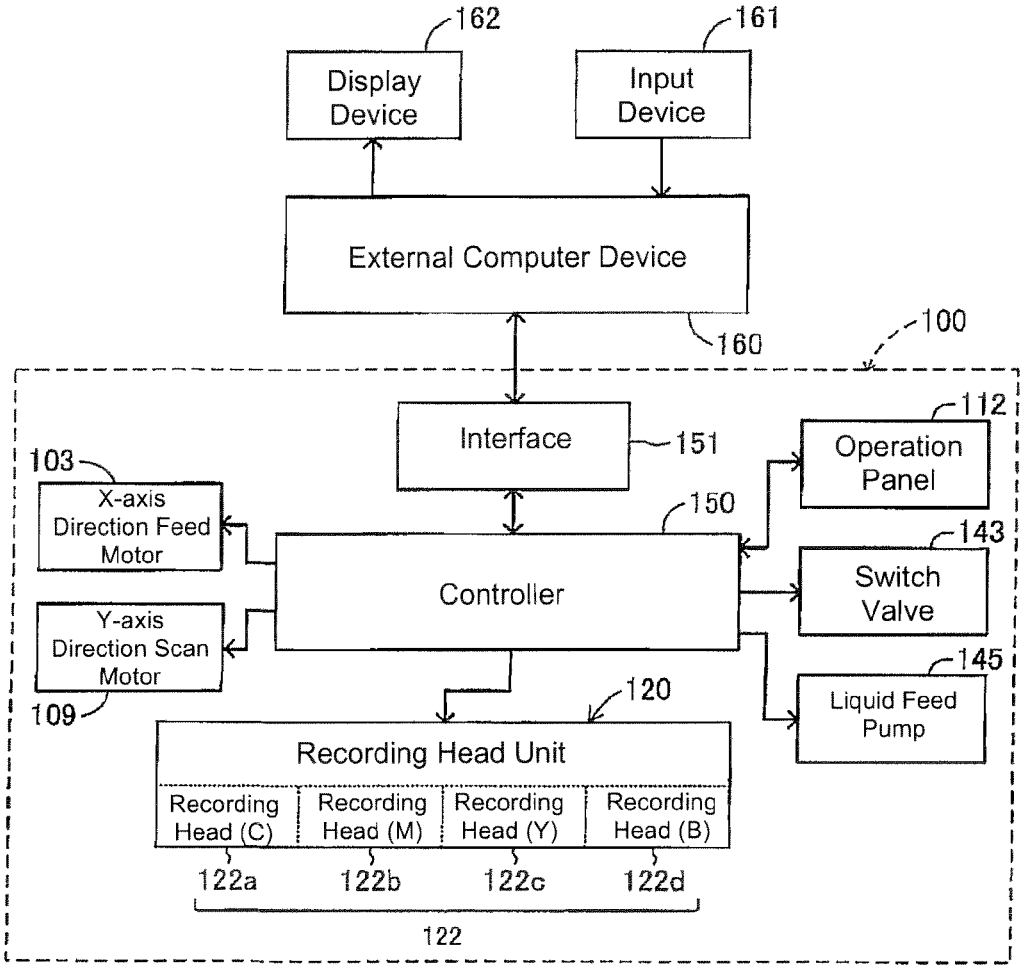
FIG. 2 illustrates a block diagram of the control system for controlling the operation of the image forming apparatus illustrated in FIG. 1.

FIG. 1 is an overall perspective view of an image forming apparatus 100 according to an embodiment of the present invention. FIG. 2 is a block diagram of a control system for controlling the operations of the image forming apparatus 100. Drawings referred to in the present specification are schematic diagrams that may exaggerate some components to facilitate a better understanding of the present invention. For this reason, dimensions among various components and proportions of the components may vary. The image forming apparatus 100 is an inkjet printer which outputs ink to the surface of a recording medium 500.

The image forming apparatus 100 is provided with a platen 101 comprising a flat surface section which is placed horizontally. The platen 101 is a mounting platform on which the recording medium 500 is placed on the flat surface section. A grid roller 102 is placed at the center of the platen 101. The grid roller 102 may be cylindrical with its upper surface section exposed. The grid roller 102 is rotated by an X-axis direction feed motor 103, which is controlled by a controller 150.

A guide rail 104 is formed above the platen 101, the guide rail 104 extends parallel to the platen 101. Four pinch rollers 105 are positioned at the bottom of the guide rail 104, each pinch roller comprises a cylindrical section opposing the grid roller 102, additionally the four pinch rollers 105 are positioned such that they are approximately equidistant from each other. The grid roller 102 and the pinch rollers 105 move the recording medium 500 in the front-to-rear direction in the illustration while gripping the recording medium 500 in the vertical direction. The front-to-rear direction in the illustration in which the recording medium 500 moves (the X-axis direction) will be referred to as the auxiliary scanning direction, while the lateral direction (the Y-axis direction) will be referred to as the main scanning direction.

The guide rail 104 supports a recording head unit 120 via a linear movement rail 106 and a linear movement block 107. The linear movement rail 106 is a single rail fixed to the guide rail 104 along the main scanning direction. The linear movement block 107 is a moving body that slides along the linear movement rail 106 and is fixed to the rear surface of the recording head unit 120. In other words, the recording head unit 120 is guided in the main scanning direction along the linear movement rail 106.

A drive belt 108 is installed towards an upper rear portion of the recording head unit 120. The drive belt 108 is connected to a Y-axis direction scan motor 109, the Y-axis direction scan motor 109 is controlled by the controller 150. The drive belt 108 is displaced in the main scanning direction by the rotational drive of the Y-axis direction scan motor 109. More specifically, the drive belt 108 moves the recording head unit 120 in the main scanning direction via the drive of the Y-axis direction scan motor 109.

The recording head unit 120, as illustrated in FIG. 1, is in a stand-by position. The stand-by position of the recording head unit 120 is the original position that serves as a reference for displacement of the recording head unit 120 in the Y-axis direction. Consequently, the recording head unit 120 is in this stand-by position during the startup operation of the image forming apparatus 100 or when a printing operation is not performed.

A long top cover 110 is positioned above the recording head unit 120, the long top cover 110 constitutes a top housing portion of the image forming apparatus 100. Further, side covers 111R and 111L are positioned on the respective sides of the platen 101 and the top cover 110, side covers 111R and 111L constitute side housing portions of the image forming apparatus 100. A control panel 112 is positioned on the front surface of the side cover 111R. The control panel 112 may receive a user input to provide instructions to the image forming apparatus 100 or the controller 150. Additionally, the control panel 112 may display information output from the image forming apparatus 100 or the controller 150. Furthermore, a stand 113 is positioned below the platen 101, the stand 113 supports the image forming apparatus 100 and allows a user to move the image forming apparatus 100.

A recording head case 121 may store four recording heads 122*a*-122*d* for discharging inks of various different colors, such as cyan; magenta; yellow; and black, onto the recording medium 500. Each of the recording heads 122*a*-122*d* has a similar configuration and will therefore be described collectively as the recording head 122.

As illustrated in FIG. 2, the controller 150 may comprise a microcomputer formed from a CPU, ROM, and RAM. The controller 150 controls various operations of the image forming apparatus 100 according to instructions provided by the user or an external computer device 160 connected via an interface 151. The controller 150 may execute programs stored in a storage device, such as a ROM. Specifically, the controller 150 controls various operations of the X-axis direction feed motor 103, the Y-axis direction scan motor 109, the recording head unit 120, the recording head 122, the switch valve 143, and the liquid feed pump 145. The external computer device 160 may be a personal computer equipped with an input device 161 comprising of a keyboard, a mouse, and a display device 162

Figure 3:
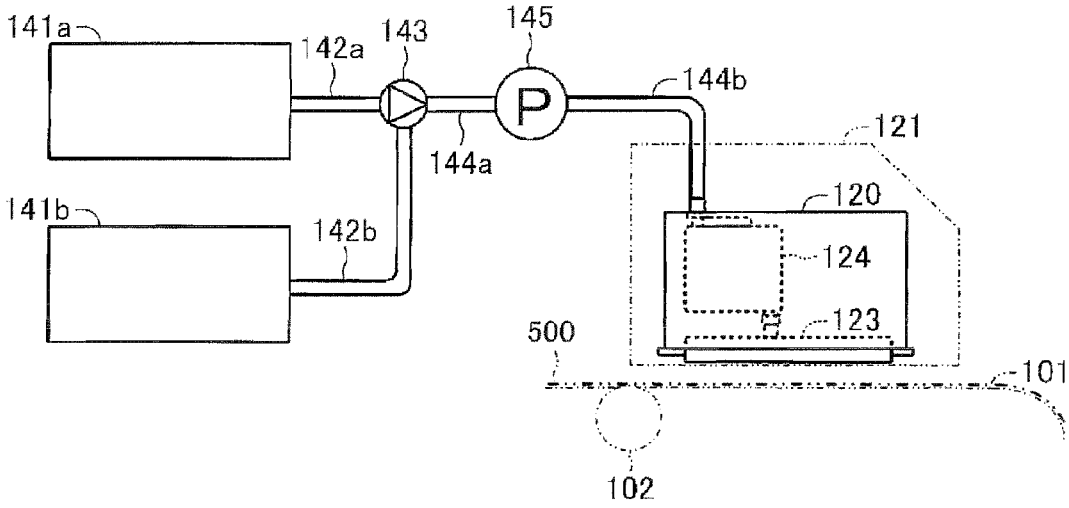
FIG. 3 is a schematic diagram illustrating the configuration from ink tanks to the recording head provided on the image forming apparatus illustrated in FIG. 1.

As illustrated in FIG. 3, the recording head 122 may comprise a nozzle section 123 for discharging ink droplets onto the recording medium 500 and a damper 124 for temporarily storing ink to be supplied to the recording head 122. The nozzle section 123 may comprise cube shape apertures for discharging ink droplets. The apertures may be linearly arranged along the auxiliary scanning direction of the recording medium 500. The nozzle section 123 is provided at the bottom surface of the recording head 122. Two ink tanks 141*a* and 141*b*, filled with the same color ink, are connected via a switch valve 143 and a liquid feed pump 145 to the damper 124. The ink tanks 141*a* and 141*b* are containers for storing ink to be discharged from the recording head 122, and are detachably installed. The ink tanks 141*a* and 141*b* are connected to the switch valve 143 via individual pipes 142*a* and 142*b*, respectively.

The switch valve 143 comprises a three-way electromagnetic valve and is connected to the liquid feed pump 145 via a common pipe 144*a*. The operation of the switch valve 143 is controlled by the controller 150 and allows either the individual pipe 142*a* or the individual pipe 142*b* to be selectively coupled with the common pipe 144*a*. In other words, the switch valve 143 selectively lets ink stored in one of the ink tanks 141*a* and 141*b* to flow towards the liquid feed pump 145. The switch valve 143 may be of any type of switch as long as it selectively allows ink stored in one of the ink tanks 141*a* and 141*b* to flow towards the liquid feed pump 145.

The liquid feed pump 145 comprises a tube pump and is controlled by the controller 150. The liquid feed pump 145 suctions ink stored from one of the ink tanks 141*a* or 141*b* via the switch valve 143 and sends the ink to the damper 124 of the recording head 122 via the common pipe 144*b*. The liquid feed pump 145 may be any type of pump which provides suction to ink stored from one of the ink tanks 141*a* or 141*b* and sends it towards the recording head 122.

Figure 4A:
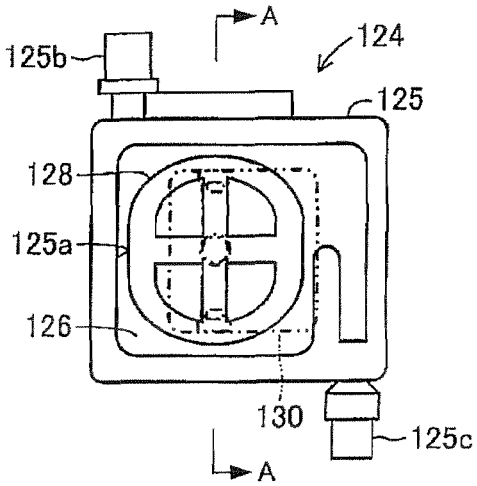
Figure 4B:
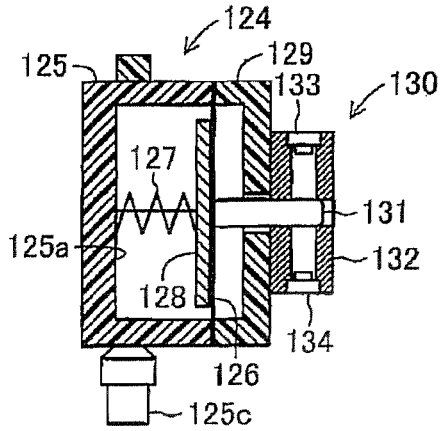

As illustrated in FIGS. 4A and 4B, the damper 124 may comprise a damper film 126, a spring body 127, and a pressing plate 128 assembled onto a main body section 125. The main body section 125 may form a rectangular plate made of resin. An ink storage section 125*a* may be formed in the main body section 125. Additionally, an ink intake opening 125*b* and an ink discharge opening 125*c* penetrate the main body section 125.

A damper film 126 covering the opening section of the ink storage section 125*a* may extend over the top surface of main body section 125. The damper film 126 may comprise a flexible resin transparent film, and may be extended along the edges of the main body section 125, such that the tension allows the damper film 126 to bend inward and outward from the ink storage section 125*a*. The damper film 125 forms a liquid-tight state that may store approximately 30 cc of ink in the interior of the ink storage section 125*a*. Additionally, a pressing plate 128 is provided via the spring body 127 at the center section of the ink storage section 125*a*.

The spring body 127 may be a coil spring for pressing the pressing plate 128 towards the damper film 126. The pressing plate 128 may be a stainless steel plate formed in a generally rectangular shape comprising a cross. The pressing plate 128 may uniformly press over the entire surface of the damper film 126 via the elastic force of the spring body 127. Accordingly, the damper film 126 may be pressed outward with respect to the ink storage section 125*a* by the spring body 127 and the pressing plate 128.

A film surface sensor 130 is provided via a cover body 129 to the exterior of the damper film 126. The film surface sensor 130 is a sensor for mechanically detecting the position of the damper film 126. The film surface sensor 130 comprises a rod-shaped sensor pin 131, a housing 132 for holding the sensor pin 131 in a manner which is slidable in the axial direction, a light emitting element 133, and a light receiving element 134 in the housing 132. The light emitting element 133 and the light receiving element 134 are placed to oppose each other with the sensor pin 131 in between.

One end section of the sensor pin 131 is fixed with an adhesive to the center of the damper film 126, such that the sensor pin 131 may be slidably displaced along the axial direction inside the housing according to the inward and outward bowing deformation of the damper film 126. The light emitting element 133 is a light source that emits infrared light, while the light receiving element 134 is a photodetector that receives the infrared light emitted from the light emitting element 133 and outputs an electrical signal. Specifically, the light emitted from the light emitting element 133 is either received by the light receiving element 134 or blocked according to the position of the sensor pin 131. The film surface sensor 130 may detect the position of the damper film 126 according to whether the light is received by the light receiving element or blocked according to the position of the sensor pin 131. The film surface sensor 130 is stored inside a housing that covers the exterior of the damper film 126 (not shown) and may be formed as one piece with the damper 124.

Operations of the image forming apparatus 100 as described above will now be described in detail. In the following description of the operation, it is assumed that there is a sufficient amount of ink initially stored in the ink tanks 141*a* and 141*b*.

After setting the recording medium 500 on the platen 101, the user may operate the input device 161 of the external computer device 160 to instruct the image forming apparatus 100 to print an image. In response to the instruction, the image forming apparatus 100 begins printing the image on the recording media 500 according to the image data output from the external computer device 160. Specifically, the controller 150 controls the operations of the X-axis direction feed motor 103 and the Y-axis direction scan motor 109 to change positions of the recording head unit 120 and the recording medium 500. The controller 150 also controls the operation of the recording head unit 122, the switch valve 143, and the liquid feed pump 145 to eject ink droplets onto the recording medium 500.

Figure 5A:
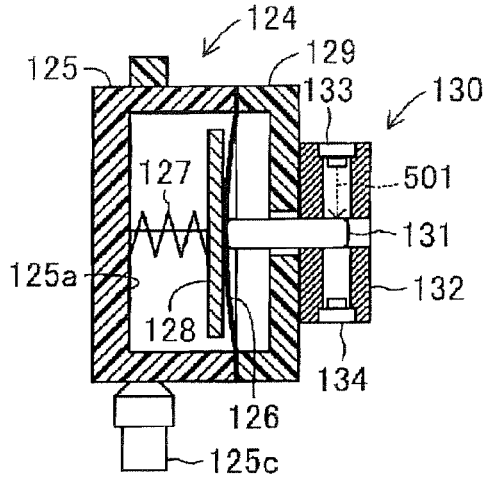
FIGS. 5A-5C are cross-sectional views of the damper and film surface sensor for illustrating operational conditions of the film surface sensor in FIG. 4B.

The controller 150 may control the switch valve 143 in order to terminate the flow of ink between the ink tank 141*b* and the liquid feed pump 145, additionally, the controller 150 controls the operation of the liquid feed pump 145 to couple the ink tank 141*a* with the liquid feed pump 145. As a result, ink stored in the ink tank 141*a* is supplied to the ink storage section 125*a* of the damper 124. During the image forming process, as illustrated in FIG. 5A, the controller 150 controls the operation of the liquid feed pump 145 such that the pressure inside the ink storage section 125*a* of the damper 124 is maintained at a predetermined pressure of approximately—40 mm $H_2O$. In other words, the controller 150 controls the ink tank 141*a* to replenish ink in the ink tank storage section 125*a* which was consumed by the image forming operation.

Figure 5B:
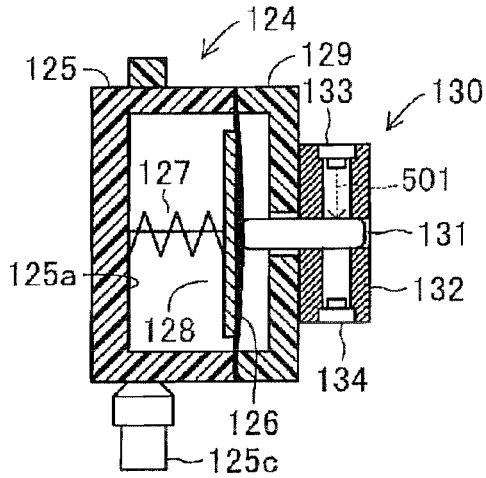
Figure 5C:
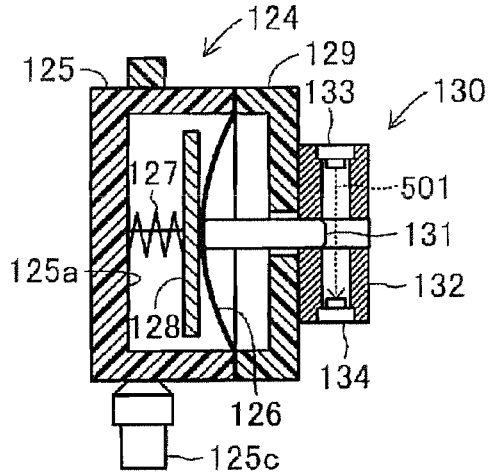

The pressure in the ink storage section 125*a* is maintained according to the detected position of the damper film 126 via the film surface sensor 130. Specifically, the controller 150 controls the liquid feed pump 145 to supply a predetermined amount of ink into the ink storage section 125*a* prior to forming an image on the recording medium 500. As illustrated in FIG. 5*b*, ink is supplied into the ink storage section 125*a* until the sensor pin 131 is displaced and the light receiving element 134 no longer detects an emitted light 501 from the light emitting element 133.

After replenishing the ink storage section 125*a* as described above, the controller 150 controls the liquid feed pump 145 to suction ink from the ink storage section 125*a* and return the suctioned ink to the ink tank 141*a*. The suction of the ink decompresses the interior of the ink storage section 125*a*. The controller 150 decompresses the interior of the ink storage section 125*a* until the light receiving element 134 detects the emitted light 501 from the light emitting element 133. In the present embodiment, the length of the sensor pin 131 is set to allow the light receiving element 134 to detect the emitted light 501 when the water head pressure inside the ink storage section 125*a* is decompressed to approximately—80 mm $H_2O$.

After decompressing the interior of the ink storage section 125*a*, as described above, the controller 150 controls the liquid feed pump 145 to supply ink from the ink tank 141*a* into the ink storage section 125*a* (see FIG. 5A). The controller 150 supplies ink into the ink storage section 125*a* until the sensor pin 131 of the film surface sensor 130 is displaced and the light receiving element 134 no longer detects the emitted light 501. Thus, the water head pressure inside the ink storage section 125*a* is restored to approximately—40 mm $H_2O$.

Accordingly, the controller 150 operates the liquid feed pump 145 to replenish the ink storage section 125*a* with ink from the ink tank 141*a*, when the water head pressure inside the ink storage section 125*a* falls with ink consumption due to the image forming process and the light receiving element 134 detects the emitted light 501. The pressure inside the ink storage section 125*a* is maintained at a negative and generally constant pressure (approximately—40 mm $H_2O$ according to the present embodiment) during the image forming process.

Ink would no longer be supplied to the ink storage section 125*a*, if ink in the ink tank 141*a* were to run out while forming images on the recording medium 500. In other words, the pressure inside the ink storage section 125*a* falls with ink consumption due to the image forming process and maintaining a negative pressure state equal or less than—80 mm $H_2O$. Consequently, the controller 150 determines that there is no more ink in the ink tank 141*a* to be supplied to the damper 124, if the light receiving element 134 continues detecting the emitted light 501 while the liquid feed pump 145 is operated. According to the present embodiment, a condition where the light receiving element 134 continues detecting the emitted light 501 when the liquid feed pump 145 attempts and fails to supply ink to the damper 124 a predetermined number of times is considered as a shortage of ink in the ink tank 141*a*.

When an ink shortage in the ink tank 141*a* is detected, the controller 150 controls the operation of the switch valve 143 to terminate the connection between the ink tank 141*a* and the liquid feed pump 145. Additionally, the controller 150 then couples the ink tank 141*b* with the liquid feed pump 145 to switch to the ink tank 141*b* in order to supply ink to the ink storage section 125*a*. As a result, ink stored in the ink tank 141*b* is supplied to the ink storage section 125*a*.

The controller 150 controls the liquid feed pump 145 to supply ink into the ink storage section 125*a* from the ink tank 141*b* until the sensor pin 131 is displaced and the light receiving element 134 no longer detects the emitted light 501 (see FIG. 5A). With this, the interior of the ink storage section 125*a* returns to a negative pressure equal to the value which was present before the ink shortage in the ink tank 141*a* (approximately—40 mm $H_2O$ according to the present embodiment). Additionally, the amount of ink stored in the ink tank 141*a* is also equal to the amount of ink present before the ink shortage in the ink tank 141*a*.

The controller 150 operates the liquid feed pump 145, as described above with respect to the ink tank 141*a*, to replenish the ink storage section 125*a* with ink from the ink tank 141*b* when the light receiving element 134 detects the emitted light 501, in order to form images on the recording medium 500. Further, the controller 150 displays the ink tank currently in use on the control panel 112, when the ink tank is switched from the ink tank 141*a* to the ink tank 141*b*. Thus, the user is informed of the ink tank currently in use and the user may replace the ink tank 141*a*, which is out of ink.

If ink were to run out in the ink tank 141*b* while forming images with ink supplied from the ink tank 141*b*, a process similar to the process that took place when ink ran out in the ink tank 141*a* takes place to detect an ink shortage in the ink tank 141*b*. In this case, the controller 150 switches the ink tank for supplying ink to the ink storage section 125*a* of the damper 124 to the ink tank 141*a* from the ink tank 141*b* through a process similar to the process for switching from the ink tank 141*a* to the ink tank 141*b*. As a result, the image forming process may continue without any interruption.

However, if there is no ink in either of the ink tanks 141*a* or 141*b*, even after performing a switching operation, the controller 150 interrupts the image forming execution and displays the appropriate information on the control panel 112. Thus, the user is made aware that the image forming is interrupted because of the ink shortage in the two ink tanks 141*a* and 141*b*.

Furthermore, according to the present embodiment, in addition to an ink shortage in either of the ink tanks 141*a* and 141*b*, the switching process between the ink tanks 141*a* and 141*b* is executed in a manner similar to an ink shortage situation, when ink fails to be discharged from the ink tanks 141*a* and 141*b*. This improves the reliability of continuous image forming processing.

In accordance with the embodiment described above, the image forming apparatus 100 may be equipped with two ink tanks similar to ink tanks 141*a* and 141*b* for each color, and further comprises a switch valve for selectively switching between the respective ink tanks for supplying ink to the recording head. The operation and parts of each recording head are similar to the operation and parts of the recording head 122 described above.

In the present embodiment, the film surface sensor 130 detects the physical amount of ink according to ink supplied to the recording head 122. Accordingly, the change in the amount of ink in the ink storage section 125*a* is less than the change in the amount of ink which may be detected from the large amounts of ink stored in ink tanks of the prior art. Consequently, a sensor device with a low sensor range and a simple physical configuration provides a more accurate detection of the remaining amount of ink in the ink tanks 141*a* and 141*b*. As a result, the remaining amount of ink in each of the plural ink tanks 141*a* and 141*b* can be accurately detected with a simple configuration, such that the configuration of the image forming apparatus 100 can be simplified and the manufacturing and maintenance costs can be reduced.

Furthermore, in embodiments of the present invention, many modifications can be made without being limited to the embodiment described above and without departing from the subject matter of the invention.

For example, the embodiment described above is configured to switch between the two ink tanks 141*a* and 141*b* for each ink color. However, the number of ink tanks is not limited to the embodiment described above as long there are two or more ink tanks. In such an example, the reliability of continuous image forming by the image forming apparatus 100 increases with a greater number of ink tanks. Specifically, the reliability is lessened when forming images on a large recording medium 500 having an A0 size or greater, for example. The advantage of the ability to continuously form images while switching among a plurality of ink tanks is significant due to the greater ink consumption and longer image forming time in forming an image on a large recording medium. Additionally, an increase in the complexity of configuration or cost can be controlled by installing a sensor device on the damper 124 or the common pipes 144*a* and 144*b*. The sensor may be installed regardless of the number of the ink tanks.

Figure 6:
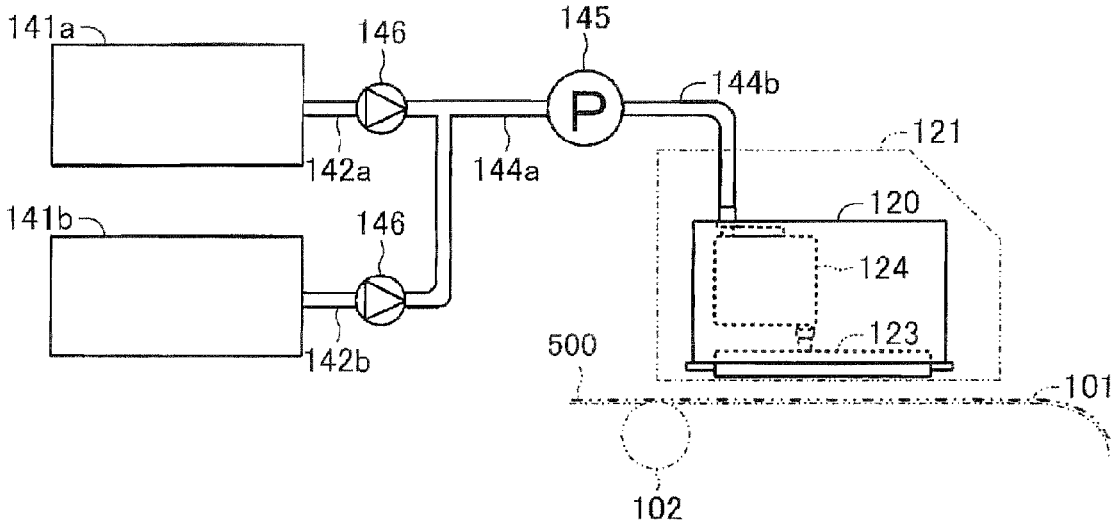
FIG. 6 is a schematic diagram illustrating the configuration of ink tanks according to another embodiment of the present invention.

Further in the embodiment described above, the switch valve 143 and the liquid feed pump 145 are used for selectively supplying ink from the ink tanks 141*a* and 141*b* to the recording head 122. However, the location and number of switch valves and liquid feed pumps are not limited to the embodiment described above. For example, a plurality of switch valves 146 may be provided on each of the individual pipes 142*a* and 142*b*, respectively, as illustrated in FIG. 6. The switch valves 146 are controlled by the controller 150 to regulate the flow of ink in the individual pipes 142*a* and 142*b*. The switch valves 146 may also be integrated with the ink tanks 141*a* and 141*b*.

Figure 7:
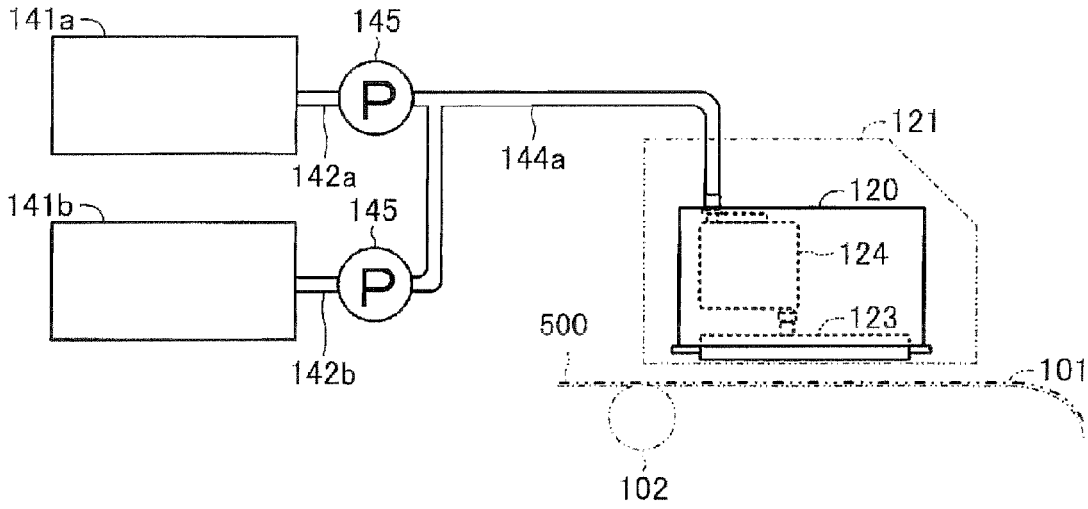
FIG. 7 is a schematic diagram illustrating the configuration of ink tanks according to another embodiment of the present invention.

Moreover, the configuration may provide a liquid feed pump 145 on each of the individual pipes 142*a* and 142*b* without using the switch valve 143, as illustrated in FIG. 7. The controller 150 may selectively switch between the ink tanks 141*a* and 141*b* for supplying ink to the damper 124 by controlling the operation of the liquid feed pumps 145 independently according to the detection result from the film surface sensor 130.

Figure 8:
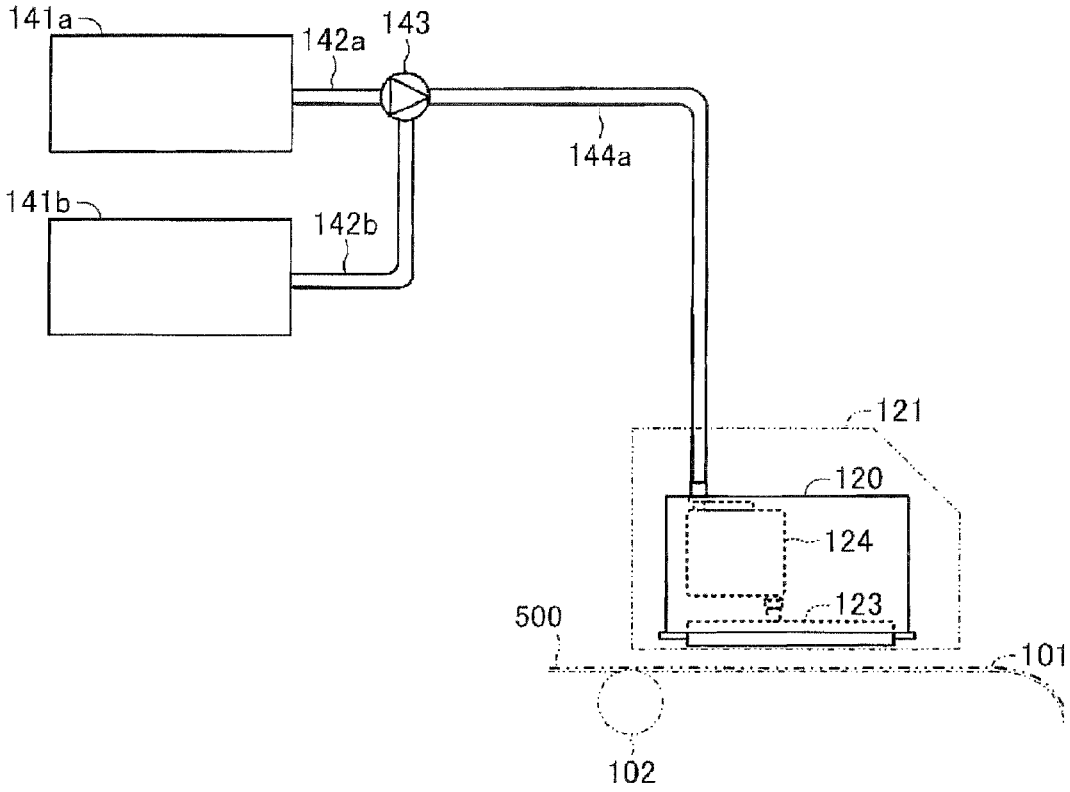
FIG. 8 is a schematic diagram illustrating the configuration of ink tanks according to another embodiment of the present invention.

Additionally, ink may be supplied to the recording head 122 from the ink tanks 141*a* and 141*b* solely via the switch valve 143 without using the liquid feed pump 145, as illustrated in FIG. 8. In this example, the ink tanks 141*a* and 141*b* may be positioned higher than the recording head 122. This would simplify the configuration of the image forming apparatus 100. In FIGS. 6-8, components similar to those in the embodiment described above are assigned the same reference numbers.

In the embodiment described above, changes in the position of the damper film 126 are detected via the film surface sensor 130. The sensor pin 131 is in contact with the damper film 126 and is displaced when the damper film 126 is displaced. However, detecting the position of the damper film 126 is not limited to the method in the embodiment described above. For example, the position of the damper film 126 may be detected by irradiating a laser beam on the damper film 126, such that the reflected light from the damper film 126 would be used to detect the position of the damper film 126 according to the intensity of reflected light or light reception position.

In the embodiment described above, the position of the damper film 126 changes according to the amount of ink stored in the ink storage section 125*a*. However, detecting the amount of ink at locations other than the damper film 126 would satisfy the purpose of the embodiments described above. For example, changes in the weight of the ink stored in the ink storage section 125*a* may be detected, or changes in the pressure inside the ink storage section 125*a* may be detected.

In the embodiment described above, the change in the amount of ink stored in the ink storage section 125*a* is detected via a sensor. However, detecting the change in the amount of ink is not limited by the embodiment described above. The amount of change in the ink may be detected via any device situated on the common ink flow path, or the common pipes 144*a* and 144*b*. For example, the common pipes 144*a* and 144*b* may be made with a flexible material such as vinyl resin and the pressure of ink flowing through the common pipes 144*a* and 144*b* may be detected. Alternatively, the common pipes 144*a* and 144*b* may be made with a transparent material and the presence of ink flowing through the common pipes 144*a* and 144*b* may be optically detected. Additionally, a flow meter may be provided in order to measure an ink flow rate in the pipe path of the common pipes 144*a* and 144*b*.

In the embodiment described above, the damper 124 is used to absorb pressure changes that result according to changes in the amount of ink in the ink tanks 141*a* and 141*b* and to prevent ink leakage from the recording head 122. However, the temporary ink storage device represented by the damper 124 may have a configuration other than the one in the embodiment described above. For example, a sub-tank with an ink capacity larger than the damper 124 may be provided on the common pipes 144*a* and 144*b* between the ink tanks 141*a* and 141*b* and the recording head 122, and a physical change sensor for detecting a change in the ink, such as ink level, weight, or pressure, may be provided on the sub-tank.

In the embodiment described above, the ink capacity of the ink storage section 125*a* of the damper 124 is approximately 30 cc. The physical amount can be detected with high accuracy suitable for switching processing between the ink tanks 141*a* and 141*b* by detecting the physical amount based on ink in a storage tank with ink capacity of 50 cc or less.

In the image forming apparatus 100 according to the present embodiment, the switching process between the ink tanks 141*a* and 141*b* may be executed in a manner similar to an ink shortage situation when ink fails to be discharged from the ink tanks 141*a* and 141*b*.

According to another embodiment of the present invention, the image forming apparatus 100 does not require the use of detection results by the film surface sensor 130 to determine an ink shortage in the ink tanks 141*a* and 141*b*. Specifically, an ink shortage may be determined by a failure to discharge ink from the ink tanks 141*a* and 141*b*.

In the embodiments described above, the ink tank 141*a* and 141*b* currently in use is displayed on the control panel 112. Informing the user of the ink tank 141*a* and 141*b* currently in use may be implemented via audio or visual notifications.

Although the present invention may be implemented using the exemplary series of operations described herein, additional or fewer operations may be performed. Moreover, it is to be understood that the order of operations shown and described is merely exemplary and that no single order of operation is required.

The foregoing embodiments and advantages are merely exemplary and are not to be construed as limiting the present invention. The present teaching can be readily applied to other types of apparatuses and processes. The description of the present invention is intended to be illustrative, and not to limit the scope of the claims. Many alternatives, modifications, and variations will be apparent to those skilled in the art.

What is claimed is:

1. An image forming apparatus comprising:

an ink tank configured to store ink;

a temporary storage device that includes a damper film configured to be deformed by pressure in the temporary storage device, the temporary storage device divided into first and second chambers by the damper film and configured to temporarily store ink that flows from the ink tank to a recording head that is configured to discharge the temporarily stored ink onto a recording medium, the first chamber including a spring body configured to press against the damper film, an intake opening and an ink discharge opening;

an adjustment device configured to adjust the flow of the temporarily stored ink to the recording head;

an ink condition sensor configured to:

detect a position of the damper film, and detect a condition of the temporarily stored ink, the detected condition comprising at least a detected quantity of the temporarily stored ink; and a control device configured to control the adjustment device according to the detected condition, wherein:

the ink condition sensor is located within a housing that protrudes from a body of the temporary storage device; and a portion of the protruded housing is located on a first side of the damper film, the first side located opposite to a second side of the damper film.

2. The image forming apparatus of claim 1, wherein the temporary storage device has an ink storage capacity of 50 cubic centimeters (cc) or less.

3. The image forming apparatus of claim 1, further comprising a display device configured to:

display an operation status of the image forming apparatus, the operation status related to the detected quantity of the temporarily stored ink; and display usage status information according to the detected quantity of the temporarily stored ink.

4. The image forming apparatus of claim 1, wherein:

the ink condition sensor comprises an electrical output element that is located within the protruded housing and is configured to output an electrical signal that controls the control device.

5. An image forming apparatus comprising:

a plurality of ink tanks configured to store ink;

one or more temporary storage devices that each include a damper film configured to be deformed by pressure in the one or more temporary storage devices, each of the one or more temporary storage devices divided into first and second chambers by the damper film and configured to temporarily store ink that flows from one or more of the plurality of ink tanks to a recording head that is configured to discharge the temporarily stored ink onto a recording medium, the first chamber including a spring body configured to press against the damper film, an intake opening and an ink discharge opening;

an ink tank switching device configured to selectively switch between two or more of the plurality of ink tanks;

an ink flow path configured to allow access temporarily stored ink to flow between the one or more temporary storage devices and the recording medium;

an ink condition sensor located in each of the one or more temporary storage devices and configured to:

detect a position of the corresponding damper film, and detect a condition of the temporarily stored ink that flows to the recording head, the detected condition comprising at least a quantity of the temporarily stored ink; and a switching control device configured to control the ink tank switching device according to the detected condition, wherein:

each ink condition sensor is located within a housing that protrudes from a body of the corresponding temporary storage device; and a portion of the protruded housing is located on a first side of the corresponding damper film, the first side is located opposite to a second side of the corresponding damper film.

6. The image forming apparatus of claim 5, wherein:

each ink condition sensor is further configured to detect an amount of ink stored in the one or more of the plurality of ink tanks.

7. The image forming apparatus of claim 6, further comprising a liquid feed pump configured to supply ink from the one or more of the plurality of ink tanks to the recording head, wherein:

the liquid feed pump comprises a valve configured to regulate a flow of ink discharged from the one or more of the plurality of ink tanks; and the switching control device is further configured to control operation of the liquid feed pump according to a amount of stored ink.

8. The image forming apparatus according of claim 5, wherein each of the one or more temporary storage device has an ink storage capacity of 50 cubic centimeters (cc) or less.

9. The image forming apparatus of claim 5, wherein:

each ink condition sensor is further configured to detect an amount of ink stored in the one or more of the plurality of ink tanks; and the display device is configured to:

display usage status information of one or more of the plurality of ink tanks according to the detected amount of stored ink, and display an operation status of the image forming apparatus.

10. The image forming apparatus of claim 5, wherein:

each ink condition sensor comprises an electrical output element that is located within the protruded housing and is configured to output an electrical signal that controls the switching control device.

11. A method of forming an image on a recording medium, the method comprising:

storing ink in a plurality of ink tanks;

temporarily storing ink that flows from the plurality of ink tanks to a recording head, the ink temporarily stored in one or more temporary storage devices that each include a damper film that is configured to be deformed by pressure in the one or more temporary storage devices and divides the corresponding temporary storage device into first and second chambers, the first chamber including a spring body configured to press against the damper film, an intake opening and an ink discharge opening;

discharging the temporarily stored ink via the recording head onto a recording medium, the recording head receiving the temporarily stored ink via an ink flow path connected to the one or more temporary storage devices;

selectively switching an output of the stored ink from two or more of the plurality of ink tanks;

detecting a position of each damper film;

detecting a condition of the stored ink via a plurality of ink condition sensors, the detected condition comprising at least a quantity of the stored ink; and controlling the selective switching of the output of the stored ink from the two or more of the plurality of ink tanks according to the detected condition, wherein:

each of the plurality of ink condition sensors are located within a housing that protrude from a body of a corresponding temporary storage device, a portion of the protruded housing is located on a first side of the corresponding damper film; and the first side is located opposite to a second side of the corresponding damper film.

12. The method of claim 11, further comprising:

controlling the selective switching of the output of the stored ink according to the detected quantity of stored ink.

13. The method of claim 11, further comprising:

supplying the temporarily stored ink to the recording head via a liquid feed pump, wherein:

a valve on the liquid feed pump controls the selective switching; and the selective switching is performed according to the detected quantity of stored ink.

14. The method of claim 11, wherein the one or more temporary storage device each have an ink storage capacity of 50 cubic centimeters (cc) or less.

15. The method of claim 11, further comprising:

detecting an amount of ink stored in the one or more of the plurality of ink tanks; and displaying an operation status according to usage status information related to the plurality of ink tanks, wherein the usage status information is based on the detected quantity of stored ink.

16. The method of claim 11, wherein:

the ink condition sensor comprises an electrical output element that is located within the protruded housing and is configured to output an electrical signal that controls the selective switching of the output of the stored ink.

17. An image forming apparatus comprising:

an ink tank configured to store ink;

a temporary storage device that includes a damper film configured to be deformed by a pressure in the temporary storage device, the temporary storage device divided into first and second chambers by the damper film and configured to temporarily store ink that flows from the ink tank to a recording head that is configured to discharge the temporarily stored ink onto a recording medium, the first chamber including a spring body configured to press against the damper film, an intake opening and an ink discharge opening;

an adjustment device configured to adjust a flow of stored ink from the ink tank;

an ink condition sensor configured to:

detect a position of the damper film, and detect a condition of the ink temporarily stored in the temporary storage device; and a control device configured to control the adjustment device according to the detected condition, wherein:

the ink condition sensor is connected to the damper film and located within a housing that protrudes from a body of the temporary storage device; and a portion of the protruded housing is located on a first side of the damper film, the first side is located opposite to a second side of the damper film.

* * * * *